US008457864B2

(12) United States Patent
Takemura

(10) Patent No.: US 8,457,864 B2
(45) Date of Patent: Jun. 4, 2013

(54) VARIABLE VALVE TIMING CONTROL APPARATUS FOR INTERNAL COMBUSTION ENGINE

(75) Inventor: Yuichi Takemura, Toyohashi (JP)

(73) Assignee: Denso Corporation, Kariya (JP)

( * ) Notice: Subject to any disclaimer, the term of this patent is extended or adjusted under 35 U.S.C. 154(b) by 561 days.

(21) Appl. No.: 12/839,585

(22) Filed: Jul. 20, 2010

(65) Prior Publication Data

US 2011/0023804 A1 Feb. 3, 2011

(30) Foreign Application Priority Data

Jul. 30, 2009 (JP) ..... 2009-178293

(51) Int. Cl.
*G06F 19/00* (2011.01)
*F01L 1/34* (2006.01)

(52) U.S. Cl.
USPC ..... 701/103; 123/90.17; 701/110

(58) Field of Classification Search
USPC . 123/90.15–90.18, 90.31, 345–347; 701/102, 701/103, 106, 110
See application file for complete search history.

(56) References Cited

U.S. PATENT DOCUMENTS 5,738,056 A 4/1998 Mikame et al.
6,330,870 B1 12/2001 Inoue et al.
6,418,896 B2 * 7/2002 Ogawa ..... 123/90.17
6,885,976 B2 * 4/2005 Yoshiki et al. ..... 702/185
7,246,581 B2 * 7/2007 Suga et al. ..... 123/90.17
7,406,935 B2 * 8/2008 Suga et al. ..... 123/90.17
8,215,272 B2 * 7/2012 Takemura et al. ..... 123/90.15
8,261,704 B2 * 9/2012 Takemura ..... 123/90.15
8,297,240 B2 * 10/2012 Inoue et al. ..... 123/90.15
2010/0269772 A1 * 10/2010 Takemura et al. ..... 123/90.17
2010/0332110 A1 * 12/2010 Wada et al. ..... 701/106

FOREIGN PATENT DOCUMENTS

JP 2002-295276 10/2002
JP 2004-251254 9/2004
JP 2007-224744 9/2007
JP 2008095540 A * 4/2008 ..... 123/90.15

* cited by examiner

*Primary Examiner* — Willis R Wolfe, Jr.
(74) *Attorney, Agent, or Firm* — Nixon & Vanderhye PC

(57) ABSTRACT

A variable valve timing control apparatus for an engine includes a hydraulic variable valve timing unit and an oil pressure control device. The variable valve timing unit has a plurality of control ranges and an ambiguity range. The apparatus learns a hold control amount for each of the plurality of control ranges when a predetermined condition is satisfied, and the hold control amount is required to control the oil pressure control device to maintain the actual VCT phase. When the target VCT phase is positioned in the ambiguity range, if a difference between the actual and target VCT phases is stably greater than a predetermined value, the apparatus switches the presently-used hold control amount learning value of one control range into the learning value for the other control range in order to compute the VCT control amount.

12 Claims, 11 Drawing Sheets

VARIABLE VALVE TIMING CONTROL APPARATUS FOR INTERNAL COMBUSTION ENGINE

CROSS REFERENCE TO RELATED APPLICATION

This application is based on and incorporates herein by reference Japanese Patent Application No. 2009-178293 filed on Jul. 30, 2009.

BACKGROUND OF THE INVENTION

1. Field of the Invention

The present invention relates to a variable valve timing control apparatus for an internal combustion engine 2. Description of Related Art Recently, the more and more internal combustion engines mounted on the vehicles are provided with hydraulic variable valve timing units that change valve timing of opening and closing an intake valve or an exhaust valve of the engine in order to increase the output, to improve the fuel efficiency, and to reduce exhaust gas emission. As shown in JP-A-2007-224744 and JP-A-2004-251254, a feed-back control amount and a hold control amount (hold duty) are used in the computation of a control amount (VCT control amount, or control duty) of a hydraulic control valve, which controls oil pressure actuating the variable valve timing unit. For example, the feed-back control amount is based on a difference between target valve timing (target VCT phase) and actual valve timing (actual VCT phase), and the hold control amount indicates a duty required to maintain the actual valve timing. The hydraulic control valve is actuated based on the above control amount such that a flow amount (oil pressure) of hydraulic oil, which is supplied to advance chambers and retard chambers of the variable valve timing unit, is changed. As above, the valve timing is advanced or retarded.

In the above, in view of the manufacturing variation of the variable valve timing unit and the hydraulic control valve hold control amount and aging of the same, the hold control amount is learned in the conventional art. In the conventional learning process of learning the hold control amount, when the actual valve timing is stable generally at the target valve timing (or when the difference between the actual valve timing and the target valve timing remains equal to or less than a predetermined value), the control amount of the hydraulic control valve in the above state is learned as the hold control amount, and the learning value is stored in the memory for update.

Also, in the hydraulic variable valve timing unit, as described in JP-A-H9-324613 (corresponding to U.S. Pat. No. 5,738,056) and JP-A-2001-159330 (corresponding to U.S. Pat. No. 6,330,870), a lock phase during the stopping of the engine is set at a middle of an adjustable range of the VCT phase such that the adjustable range of the valve timing (VCT phase) is enlarged. In the above, the intermediate lock position, at which the phase is locked during the stopping of the engine, is set at a phase suitable for starting the engine. Thus, the engine is started while the phase is at the intermediate lock position. Then, when oil pressure is increased to an appropriate oil pressure due to the engine rotation increase (oil pump rotation increase) after the completion of the engine start, the lock is released in order to start the feed-back control of the valve timing.

In the variable valve timing unit having an intermediate lock mechanism as in JP-A-H9-324613 and JP-A-2001-159330, a control characteristic of the VCT phase has multiple different control ranges. In general, if the control characteristic of the VCT phase varies with each of the control ranges, the hold control amount varies with each of the control ranges.

Thus, it has been proposed that the hold control amount is learned for each control range, and that the VCT control amount is computed by using a learning value of the hold control amount in the control range, within which the target VCT phase stays. However, because a boundary of the control ranges varies with manufacturing variation and aging of the variable valve timing unit, it is difficult to determine the control range, within which control range the target VCT phase of interest stays, when the target VCT phase is positioned around the boundary.

In JP-A-2002-295276, when a learning correction amount of the hold control amount becomes equal to or greater than a predetermined value, the boundary of the control ranges is learned. However, it takes substantially long time to learn the boundary, and also the likelihood of the erroneous learning becomes higher. Thus, the deterioration of the accuracy in the control around the boundary may be unavoidable disadvantageously.

SUMMARY OF THE INVENTION

The present invention is made in view of the above disadvantages. Thus, it is an objective of the present invention to address at least one of the above disadvantages.

To achieve the objective of the present invention, there is provided a variable valve timing control apparatus for an internal combustion engine having a crankshaft and a camshaft, the variable valve timing control apparatus including a hydraulic variable valve timing unit, an oil pressure control device. VCT phase control means, and hold control amount learning means. The hydraulic variable valve timing unit is configured to adjust valve timing by changing a variable cam timing (VCT) phase that is a rotational phase of the camshaft relative to the crankshaft. The oil pressure control device is configured to control oil pressure that actuates the variable valve timing unit. The VCT phase control means feed-back controls a VCT control amount of the oil pressure control device such that an actual VCT phase becomes a target VCT phase. The variable valve timing unit is configured to have a plurality of control ranges of the VCT phase, each of which has a different control characteristic. An ambiguity range is a predetermined range defined around a boundary between the plurality of control ranges and has a control characteristic that is difficult to be identified. The hold control amount learning means learns a hold control amount for each of the plurality of control ranges when a predetermined hold control amount learning execution condition is satisfied, and the hold control amount is required to control the oil pressure control device to maintain the actual VCT phase. When the target VCT phase is positioned away from the ambiguity range, the VCT phase control means computes the VCT control amount by using the hold control amount learning value of one of the plurality of control ranges, in which the target VCT phase is positioned. When the target VCT phase is positioned in the ambiguity range, if a difference between the actual VCT phase and the target VCT phase is stably equal to or greater than a predetermined value, the VCT phase control means executes a VCT control amount computation process, in which one of the following is performed: (a) the VCT phase control means switches the hold control amount learning value of one of the plurality of control ranges, which is presently used in computation of the VCT control amount, into the hold control amount learning value for the other one of the plurality of control ranges such that the hold control amount learning value for the other one of the plurality of control ranges is used in the computation of the VCT control amount, the other one of the plurality of control ranges being positioned adjacent to the ambiguity range; and (b) the VCT phase control means corrects the VCT control amount based on a difference between the hold control amount learning values of two of the plurality of control ranges, which are positioned adjacent to the ambiguity range.

To achieve the objective of the present invention, there is also provided a variable valve timing control apparatus for an internal combustion engine having a crankshaft and a camshaft, the variable valve timing control apparatus including a hydraulic variable valve timing unit, an oil pressure control device. VCT phase control means, and hold control amount learning means. The hydraulic variable valve timing unit is configured to adjust valve timing by changing a variable cam timing (VCT) phase that is a rotational phase of the camshaft relative to the crankshaft. The oil pressure control device is configured to control oil pressure that actuates the variable valve timing unit. The VCT phase control means feed-back controls a VCT control amount of the oil pressure control device such that an actual VCT phase becomes a target VCT phase. The variable valve timing unit is configured to have a plurality of control ranges of the VCT phase, each of which has a different control characteristic. An ambiguity range is a predetermined range defined around a boundary between the plurality of control ranges and has a control characteristic that is difficult to be identified. The hold control amount learning means learns a hold control amount for each of the plurality of control ranges when a predetermined hold control amount learning execution condition is satisfied, and the hold control amount is required to control the oil pressure control device to maintain the actual VCT phase. When the target VCT phase is positioned away from the ambiguity range, the VCT phase control means computes the VCT control amount by using the hold control amount learning value of one of the plurality of control ranges, in which the target VCT phase is positioned. When the target VCT phase is positioned in the ambiguity range, the VCT phase control means executes the followings: (a) the VCT phase control means prohibits the hold control amount learning means from learning the hold control amount; and (b) the VCT phase control means changes the ambiguity range if a control state of the actual VCT phase satisfies a predetermined condition.

To achieve the objective of the present invention, there is also provided a variable valve timing control apparatus for an internal combustion engine having a crankshaft and a camshaft, the variable valve timing control apparatus including a hydraulic variable valve timing unit, an oil pressure control device, VCT phase control means, and hold control amount learning means. The hydraulic variable valve timing unit is configured to adjust valve timing by changing a variable cam timing (VCT) phase that is a rotational phase of the camshaft relative to the crankshaft. The oil pressure control device is configured to control oil pressure that actuates the variable valve timing unit. The VCT phase control means feed-back controls a VCT control amount of the oil pressure control device such that an actual VCT phase becomes a target VCT phase. The VCT phase is variable within a variable range that is divided into a first control range, a second control range, and an ambiguity range. The ambiguity range is adjacently positioned between the first and second control ranges and has a control characteristic that is difficult to be identified. The first and second control ranges have different control characteristic from each other. The hold control amount learning means learns a hold control amount for each of the first and second control ranges when a predetermined hold control amount learning execution condition is satisfied, and the hold control amount is required to control the oil pressure control device to maintain the actual VCT phase. When the target VCT phase is positioned away from the ambiguity range, the VCT phase control means computes the VCT control amount by using the hold control amount learning value of one of the first and second control ranges, in which the target VCT phase is positioned. When the target VCT phase is positioned in the ambiguity range, if a difference between the actual VCT phase and the target VCT phase is stably equal to or greater than a predetermined value, one of the following is performed; (a) the VCT phase control means switches the hold control amount learning value used in computation of the VCT control amount from the hold control amount learning value for the first control range, which is presently used in computation of the VCT control amount, to the hold control amount learning value for the second control range such that the VCT phase control means computes the VCT control amount by using the hold control amount learning value for the second control range; and (b) the VCT phase control means corrects the VCT control amount based on a difference between the hold control amount learning values of the first and second control ranges.

BRIEF DESCRIPTION OF THE DRAWINGS

The invention, together with additional objectives, features and advantages thereof, will be best understood from the following description; the appended claims and the accompanying drawings in which:

DETAILED DESCRIPTION OF PREFERRED EMBODIMENTS

The first embodiment and the second embodiment of the present invention, which are applied to a variable valve timing unit of an intake valve, will be described below.

First Embodiment

The first embodiment of the present invention will be described with reference to FIGS. 1 to 9.

Figure 1:
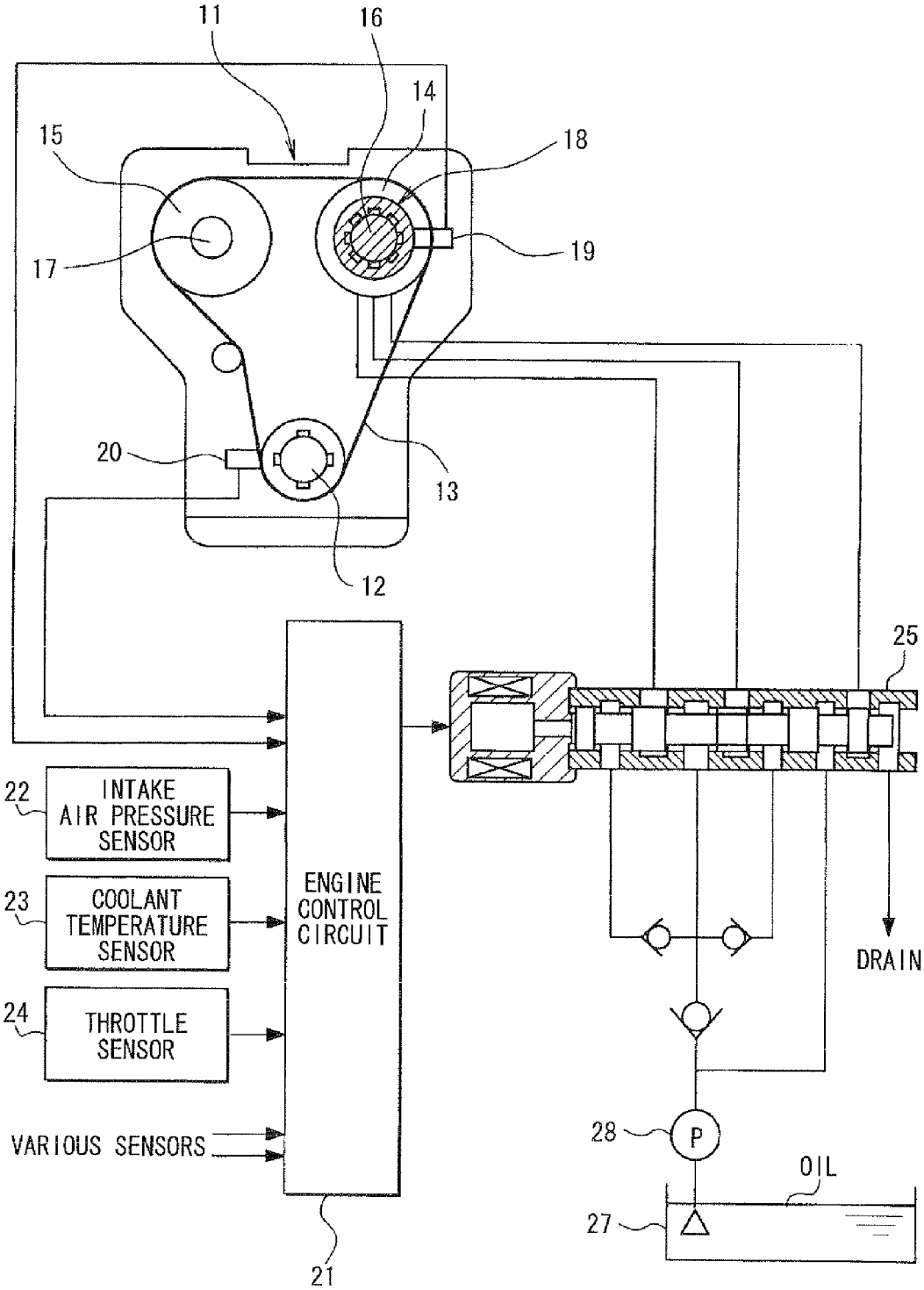
FIG. 1 is a schematic configuration illustrating an entirety of a control system according to the first embodiment of the present invention.

As shown in FIG. 1, an engine 11 (internal combustion engine) transmits drive force from a crankshaft 12 to an intake camshaft 16 and an exhaust camshaft 17 through a timing chain 13 and sprockets 14, 15. The intake camshaft 16 is provided with a variable valve timing unit 18 (VCT technology) that adjusts an advance amount or a variable cam timing (VCT) phase of the intake camshaft 16 relative to the crankshaft 12. More specifically, the VCT phase is a rotational angular position of the intake camshaft 16 relative to a rotational angular position of the crankshaft 12.

Also, a cam angle sensor 19 is provided at a position radially outward of the intake camshaft 16 for outputting cam angle signal pulses at predetermined cam angles in order to identify cylinders. Also, a crank angle sensor 20 is provided at a position radially outward of the crankshaft 12 for outputting crank angle signal pulses at predetermined crank angles. The signals outputted from the cam angle sensor 19 and the crank angle sensor 20 are fed to an engine control circuit 21. The engine control circuit 21 computes actual valve timing (actual VCT phase) of the intake valve and computes an engine rotation speed based on a frequency (pulse interval) of the output pulses of the crank angle sensor 20. Also, the other signals outputted by various sensors (an intake air pressure sensor 22, a coolant temperature sensor 23, a throttle sensor 24) for detecting an engine operational state are fed to the engine control circuit 21.

The engine control circuit 21 executes fuel injection control and ignition control based on the engine operational state detected by the various sensors. Also, the engine control circuit 21 executes variable valve timing control (VCT phase feed-back control), in which the engine control circuit 21 feed-back controls oil pressure that actuates the variable valve timing unit 18 such that the actual valve timing of the intake valve (or an actual VCT phase) becomes target valve timing (target VCT phase) determined in accordance with an engine operational state.

Figure 2:
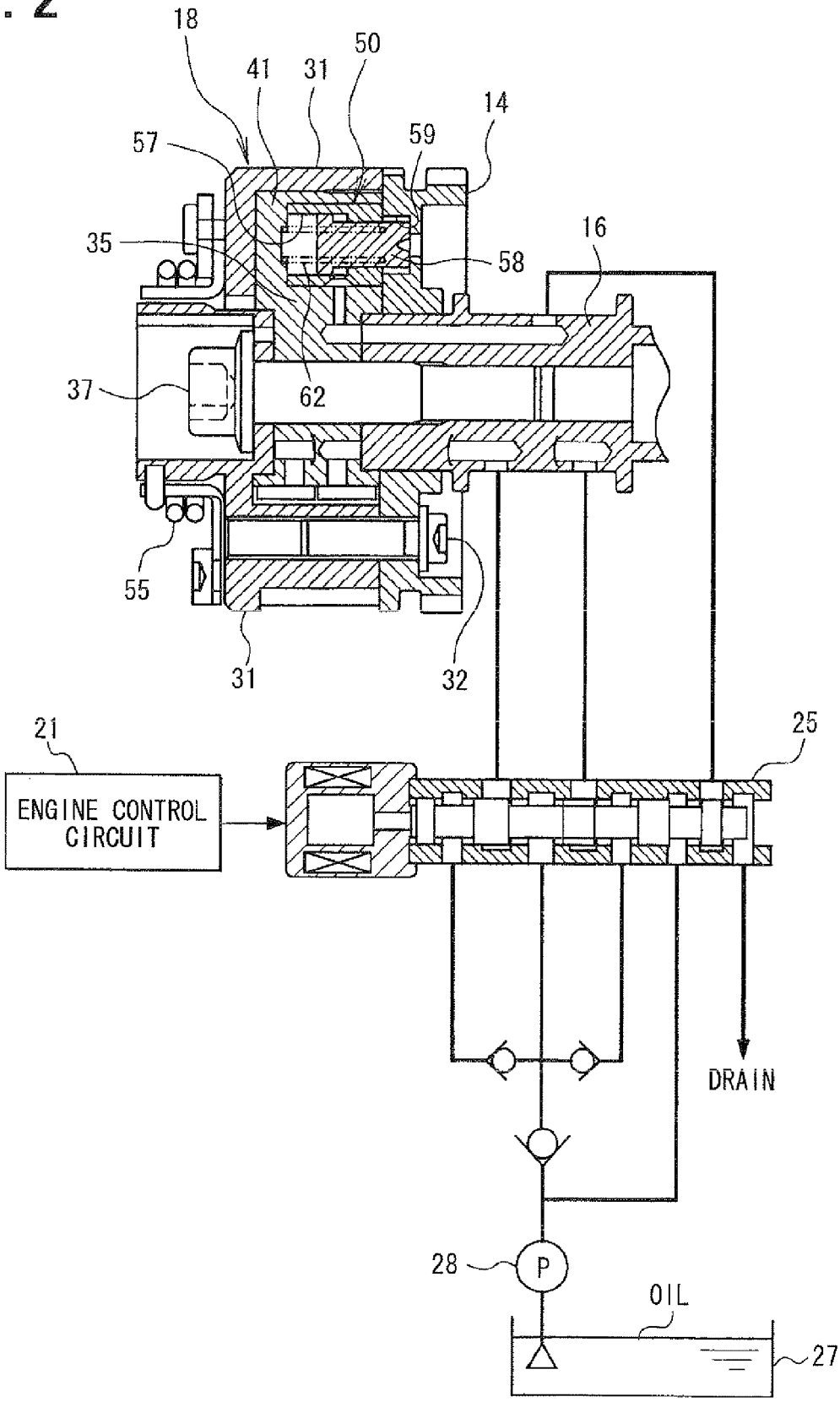
FIG. 2 is a sectional view of a variable valve timing unit and an oil pressure control circuit taken along a longitudinal axis thereof.

Next, the variable valve timing unit 18 will be described with reference to FIGS. 2 and 3.

The variable valve timing unit 18 has a housing 31 that is fixed to the sprocket 14 through a bolt 32. The sprocket 14 is movably supported at a position radially outward of the intake camshaft 16. Thus, when the rotation of the crankshaft 12 is transmitted to the sprocket 14 and the housing 31 through the timing chain 13, the sprocket 14 and the housing 31 are rotated synchronously with the crankshaft 12.

The intake camshaft 16 has one end portion that is fixed to a rotor 35 through a bolt 37. The rotor 35 is received within the housing 31 and is rotatable relative to the housing 31.

Figure 3:
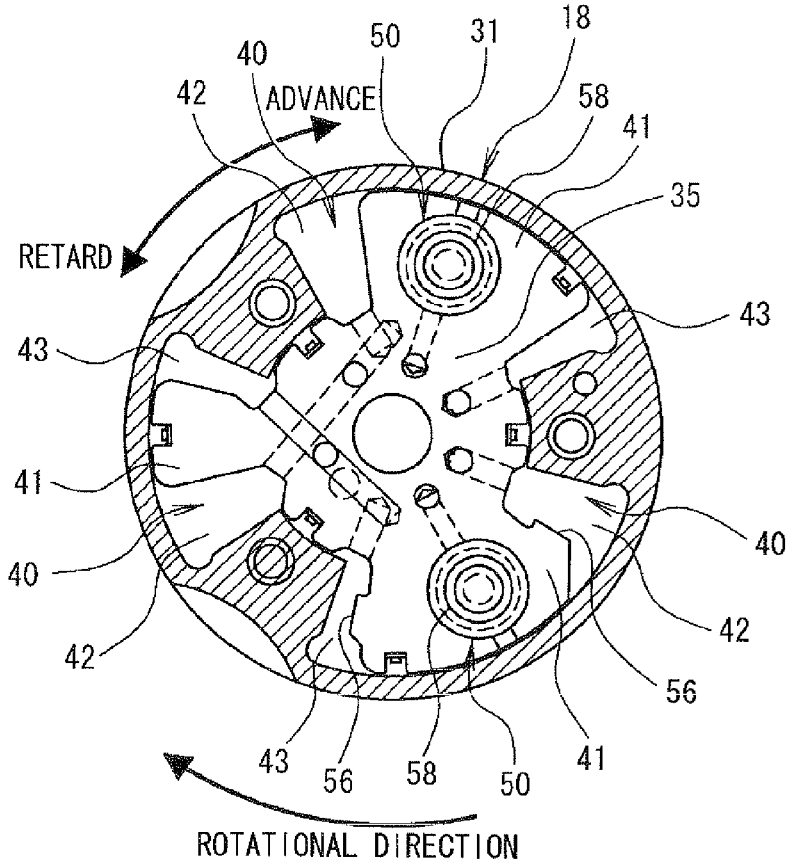
FIG. 3 is a sectional view of the variable valve timing unit taken along a plane perpendicular to a rotational axis of the variable valve timing unit.

As shown in FIG. 3, multiple vane receiving chambers 40 are formed within the housing 31, and vanes 41 are formed at radially outward parts of the rotor 35. Each of the vane receiving chambers 40 is divided into an advance chamber 42 and a retard chamber 43 by toe corresponding vane 41. At least one of the vanes 41 has both circumferential ends that are provided with respective steppers 56. Each of the stoppers 56 limits a rotational range of the rotor 35 (the vane 41) relative to the housing 31. The stoppers 56 defines a full retard position and a full advance position of an adjustable range of the actual VCT phase (camshaft phase).

The variable valve timing unit 18 is provided with an intermediate lock mechanism 50 that is adapted to lock the VCT phase at an intermediate lock position. For example, the intermediate lock position corresponds to a position or a phase between the full advance position and the full retard position (for example, a generally middle position) of the above adjustable range of the VCT phase. The intermediate lock mechanism 50 will be described below. A lock pin receiving hole 57 is provided to one of the multiple vanes 41. Alternatively, multiple lock pin receiving holes 57 may be provided to the multiple vanes 41, respectively. The lock pin receiving hole 57 receives therein a lock pin 58 that is displaceable to project from the lock pin receiving hole 57. The lock pin 58 locks the rotation of the rotor 35 (the vane 41) relative to the housing 31 when the lock pin 58 projects from the lock pin receiving hole 57 toward the sprocket 14 to be inserted into a lock hole 59 of the sprocket 14. As a result, the VCT phase is locked at the intermediate lock position located generally in the middle of the adjustable range. The intermediate lock position is set at a phase that is suitable for starting the engine 11. It should be noted that the lock hole 59 may be alternatively provided to the housing 31.

The lock pin 58 is urged by a spring 62 in a lock direction for locking the VCT phase. In other words, the lock pin 58 is urged in a projection direction, in which the lock pin 58 is capable of projecting from the lock pin receiving hole 57. Also, an oil pressure chamber for releasing the lock is formed between (a) the radially outward part of the lock pin 58 and (b) the lock pin receiving hole 57. The oil pressure chamber is used to control oil pressure that actuates the lock pin 58 in a lock release direction for unlock the rotation of the rotor 35 to release the locked VCT phase. For example, when the pressure in the oil pressure chamber becomes high, the pressure urges the lock pin 58 in the lock release direction such that the lock pin 58 is displaced in the lock release direction against the urging force of the spring 62. Also, when the pressure in the oil pressure chamber becomes low, or is released, the pressure does not urge the lock pin 58 substantially. As a result, the lock pin 58 is urged only in the lock direction by the urging force of the spring 62, and thereby the lock pin 58 is displaced in the lock direction. In the present specification, the operation of urging the lock pin 58 in the lock direction indicates the state, where the pressure in the oil pressure chamber becomes low, and thereby the lock pin 58 is allowed to be displaced in the lock direction as described above. It should be noted that the housing 31 is provided with a spring 55 (see FIG. 2) that provides spring force for assisting oil pressure applied to rotate the rotor 35 relatively in an advance direction during an advance control. The spring 55 may be a helical torsion spring and serves as urging means. In the variable valve timing unit 18 of the intake valve, torque of the intake camshaft 16 is applied in a direction for shifting the VCT phase in a retard direction. The above means that the spring 55 urges the rotor 35 to shift the VCT phase in the advance direction that is opposite from the direction of torque applied to the intake camshaft 16.

Figure 5:
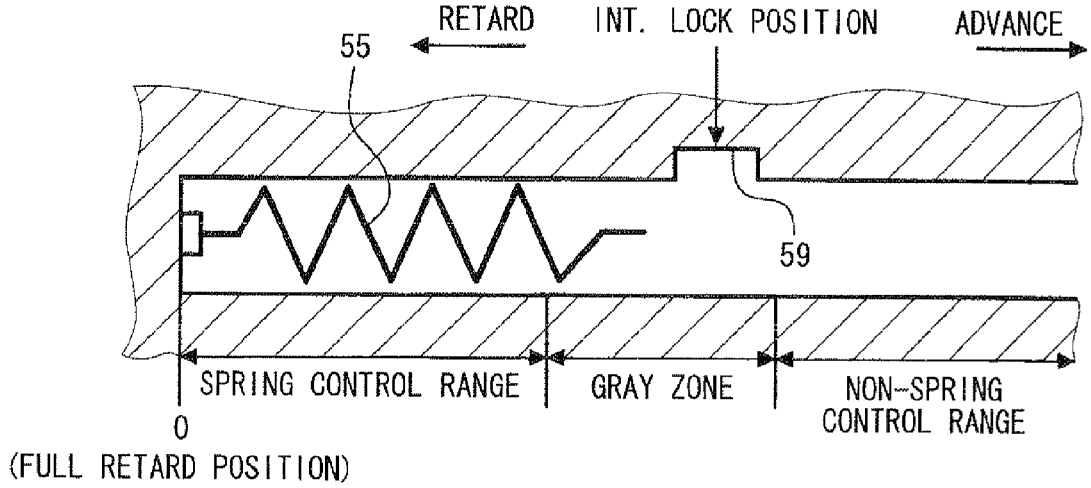
FIG. 5 is a conceptual diagram for explaining a relation between a spring control range and a non-spring control range.

In the first embodiment, as shown in FIG. 5, it is designed such that the force of the spring 55 is applied to the rotor 35 in the advance direction when the VCT phase stays within a range from the full retard position to a position immediately before the intermediate lock position. For example, the spring 55 is designed to work for a fail-safe operation during restarting the engine 11 after the engine 11 has abnormally stopped, such as an engine stall. More specifically, when the engine is started in a state, where the actual VCT phase is on a retard side of the intermediate lock position while the lock pin 58 is not fitted with the lock pin receiving hole 57, the spring force of the spring 55 assists an advance operation, in which the actual VCT phase is advanced from the retard side toward the intermediate lock position such that the lock pin 58 is fitted into the lock pin receiving hole 57 in order to lock the VCT phase, during the cranking by a starter (not shown).

In contrast, when the engine is started in another state, where the actual VCT phase is on an advance side of the intermediate lock position, torque of the intake camshaft 16 is applied in the retard direction during the cranking. As a result, the torque of the intake camshaft 16 retards the actual VCT phase from the advance side toward the intermediate lock position such that the lock pin 58 is engaged with the lock pin receiving hole 57 for locking the VCT phase.

Figure 4A:
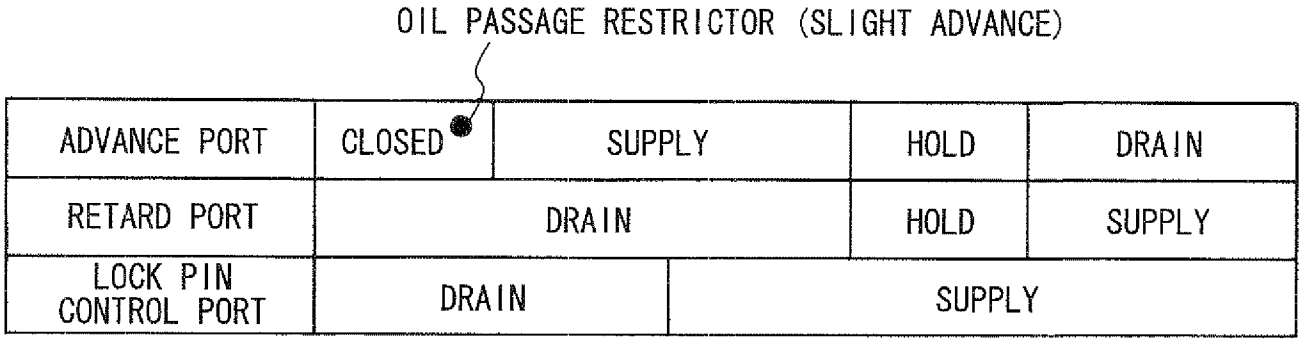
FIG. 4A is a diagram for explaining a pattern for switching between an advance post, a retard port, a lock pin control port of a hydraulic control valve.
Figure 4B:
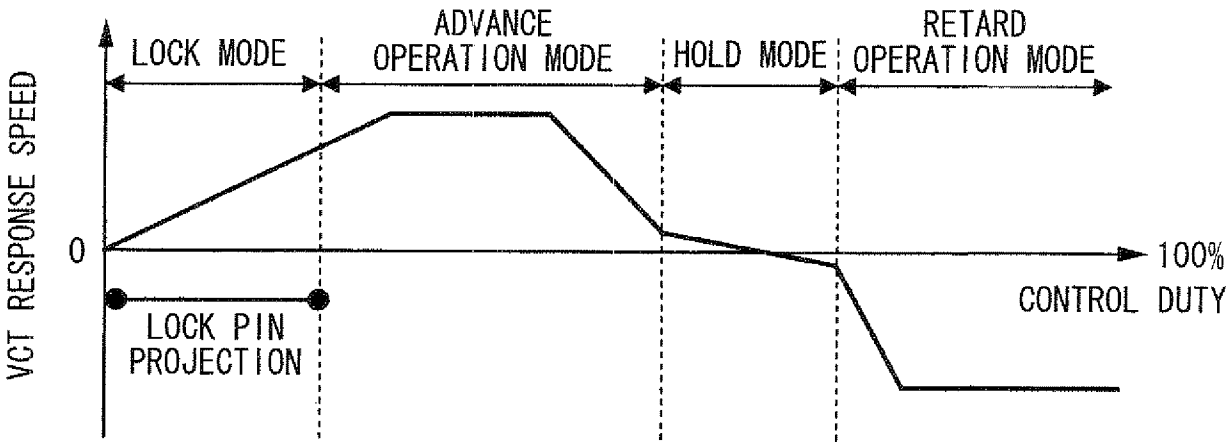
FIG. 4B is a control characteristic diagram of the hydraulic control valve for illustrating a relation between (a) a VCT response speed and (b) four control ranges (a lock mode, an advance operation mode, a hold mode, a retard operation mode)

Also, in the first embodiment, the oil pressure control device controls oil pressure that actuates the VCT phase and the lock pin 58 of the variable valve timing unit 18. The oil pressure control device of the present embodiment includes a hydraulic control valve 25 that is structured to function as a phase control hydraulic control valve and as a lock control hydraulic control valve. For example, the phase control hydraulic control valve controls oil pressure that actuates the VCT phase, and the lock control hydraulic control valve controls oil pressure that actuates the lock pin 58. In other words, the hydraulic control valve 25 integrally includes (a) first means for controlling oil pressure that actuates the VCT phase and (b) second means for controlling oil pressure that actuates the lock pin 58. An oil pump 28 is driven by drive force of the engine 11 and pumps oil (hydraulic oil) in an oil pan 27 to supply the oil to the hydraulic control valve 25. The above hydraulic control valve 25 is, for example, an eight-port and four-position spool valve. As shown in FIGS. 4A and 4B, the hydraulic control valve 25 is operated under four operational modes based on a control duty (VCT control amount) of the hydraulic control valve 25. The operational modes have a lock mode (slight advance operation mode), an advance operation mode, a hold mode, and a retard operation mode, for example. Due to the above configuration, the single hydraulic control valve 25 is capable of controlling both of (a) the oil pressure actuating the VCT phase and (b) the oil pressure actuating the lock pin 58. As a result, it is possible to effectively reduce the number of components, and thereby reducing the cost advantageously.

When the operation mode is the lock mode (slight advance operation mode), a lock pin control port of the hydraulic control valve 25 is brought into communication with the drain port such that oil pressure in the lock release oil pressure chamber within the lock pin receiving hole 57 is released, and thereby the spring 62 is allowed to displace the lock pin 58 in the lock direction (projection direction) without the counter force of the oil pressure that otherwise prevents the displacement of the lock pin 58 in the lock direction. Also, a retard port of the hydraulic control valve 25 is brought into communication with the drain port such that oil pressure in the retard chambers 43 are released. In the above communication state, a restrictor in an oil passage connected with an advance port of the hydraulic control valve 25 is slowly changed in accordance with the control duty of the hydraulic control valve 25 such that oil is slowly supplied to the advance chambers 42 through the advance port. As a result, the actual VCT phase is gently shifted in the advance direction.

When the operation mode is the advance operation mode, the retard port of the hydraulic control valve 25 is brought into communication with the drain port such that oil pressure in the retard chamber 43 is released. In the above operation state, oil pressure supplied to the advance chambers 42 through the advance port of the hydraulic control valve 25 is changed in accordance with the control duty of the hydraulic control valve 25. As a result, the actual VCT phase is shifted in the advance direction.

When the operation mode is the hold mode, oil pressure in both the advance chamber 42 and the retard chamber 43 are maintained such that the actual VCT phase is prevented from being shifted.

When the operation mode is the retard operation mode, the advance port of the hydraulic control valve 25 is brought into communication with the drain port such that oil pressures in the advance chambers 42 are released. In the above operation state, oil pressure supplied to the retard chambers 43 through the retard port of the hydraulic control valve 25 is changed in accordance with the control duty of the hydraulic control valve 25 such that the actual VCT phase is shifted in the retard direction.

When the operation mode is the control mode other than the lock mode (such as the retard operation mode, the hold mode, the advance operation mode), the lock release oil pressure chamber within the lock pin receiving hole 57 is filled with oil in order to increase oil pressure in the lock release oil pressure chamber. As a result, the increased pressure of oil pulls the lock pin 58 out of the lock hole 59 such that the lock of the lock pin 58 is released. In other words, the increased oil pressure disengages the lock pin 58 from the lock hole 59 such that the lock of the VCT phase by the lock pin 58 is released.

It should be noted that in the first embodiment, the control mode is changed in the order from the lock mode (slight advance operation mode), the advance operation mode, the hold mode, to the retard operation mode in accordance of the increase of the control duty of the hydraulic control valve 25. However, for example, the control mode may be alternatively changed in the order of the retard operation mode, the hold mode, the advance operation mode, and the lock mode (slight advance operation mode) in accordance with the increased of the control duty of the hydraulic control valve 25. Further alternatively, the control mode may be changed in the other order of the lock mode (slight advance operation mode), the retard operation mode, the hold mode, and the advance operation mode. Also, in a case, where a control range of the lock mode (slight advance operation mode) is directly adjacent to a control range of the retard operation mode, the operation of the hydraulic control valve 25 in the control range for the lock mode (slight advance operation mode) may be executed as follows. For example, in the lock mode, oil pressure in the lock release oil pressure chamber within the lock pin receiving hole 57 is released, and thereby the spring 62 is allowed to displace the lock pin 58 in the lock direction. Simultaneously, the advance port is brought into communication with the drain port such that oil pressure is the advance chamber 42 is released. In the above operation condition, an operational state of the restrictor of the oil passage connected with the retard port is slowly changed in accordance with the control duty of the hydraulic control valve 25 such that oil is slowly supplied to the retard chambers 43 through the retard port. As a result, the actual VCT phase is gently shifted in the retard direction.

The engine control circuit 21 serves as VCT phase control means and computes the target VCT phase (target valve timing) based on the engine operational condition during the VCT phase feed-back control (variable valve timing control). Then, the control duty (VCT control amount) of the hydraulic control valve 25 is feed-back controlled through, for example, a PD control such that oil pressure supplied to the advance chambers 42 and the retard chambers 43 of the variable valve timing unit 18 is feed-back controlled in order to cause the actual camshaft phase of the intake camshaft 16 (actual valve timing of the intake valve) to become the target VCT phase (target valve timing).

Furthermore, the engine control circuit 21 also functions as hold control amount learning means for learning a hold duty (hold control amount) when a predetermined hold duty learning execution condition (hold control amount learning execution condition) is satisfied. More specifically, the hold duty is required to cause the hydraulic control valve 25 to maintain the actual VCT phase, which is controlled based on a control duty of the hydraulic control valve 25. During a VCT phase F/B control, a control duty is obtained by adding a F/B correction amount and a target tracking correction amount to a learning value of the hold duty (hold control amount learning value).

$$\text{control duty} = \text{hold duty learning value} + F/B \text{ correction amount} + \text{target tracking correction amount}$$

$$F/B \text{ correction amount} = Kp \cdot \Delta VT + Kd \cdot d(\Delta VT)/dt$$

$$d(\Delta VT)/dt = [\Delta VT(i) - \Delta VT(i-1)]/dt, \text{ where}$$

Kp is a proportional gain;

Kd is a derivative gain;

ΔVT is a difference between a target VCT phase and an actual VCT phase;

ΔVT(i) is a present difference; and

ΔVT(i−1) is a previous difference, dt is a computation cycle.

The target tracking correction amount is determined by a target tracking control (described later) when the target VCT phase is positioned in a gray zone (ambiguity range) and simultaneously when the actual VCT phase is stable or is not substantially moving.

Also, the engine control circuit 21 controls a control duty of the hydraulic control valve 25 such that a lock control, which shifts the VCT phase toward the intermediate lock position, is started when a lock request is generated in order to, for example, stop the engine 11. Typically, in the lock control, the lock pin 58 is allowed to be displace or to project for locking the VCT phase at the intermediate lock position.

As shown in FIGS. 4A and 4B, the control characteristic of the variable valve timing unit 18 shows a nonlinear control characteristic, which has a low-responsive range (dead zone) and high-responsive ranges located at both ends of the low-responsive range. For example, the VCT response speed in the low-responsive range is substantially small, and the VCT response speed in the high-responsive range is greater than that in the low-responsive range. Also, the real hold duty (hold control amount), which is required to control the oil pressure control valve 25 to really hold the actual VCT phase, exists in the low-responsive range.

Figure 6A:
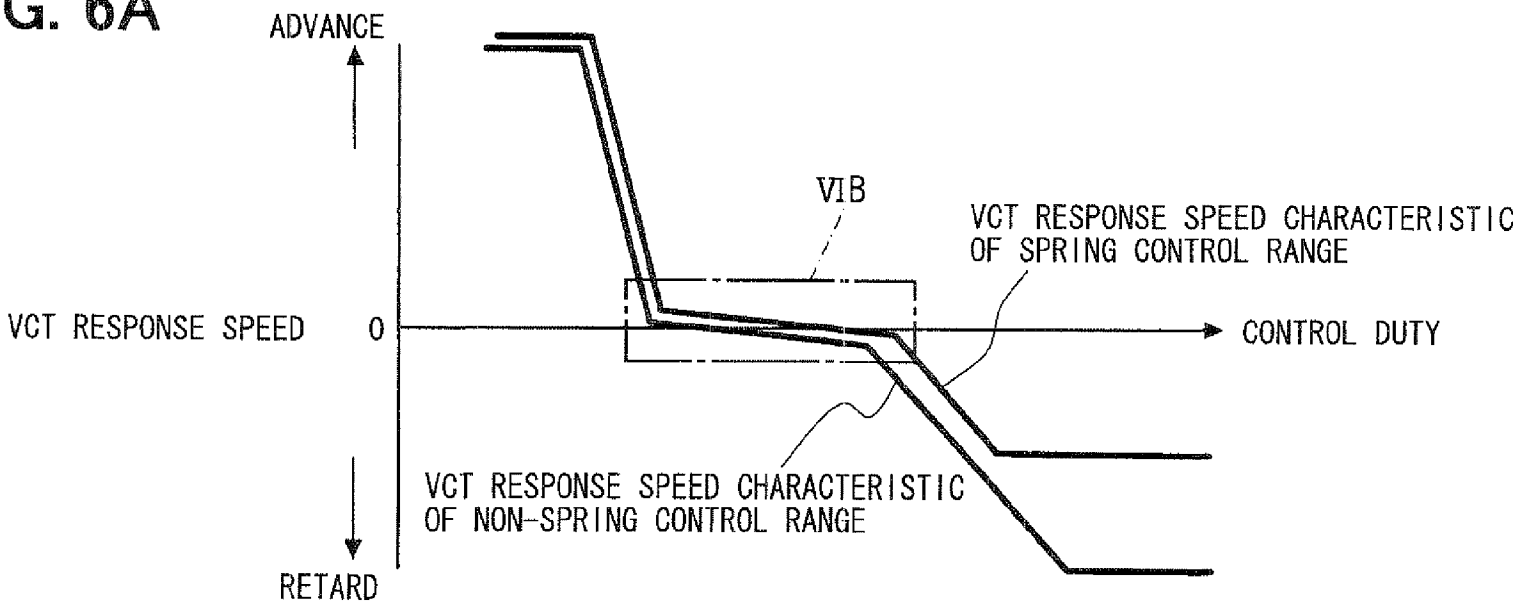
FIG. 6A is a diagram for explaining a relation between (a) a VCT response speed characteristic of the variable valve timing unit as a function of a hold duty of each of the spring control range and (b) the VCT response speed characteristic as a function of a hold duty of the non-spring control range.
Figure 6B:
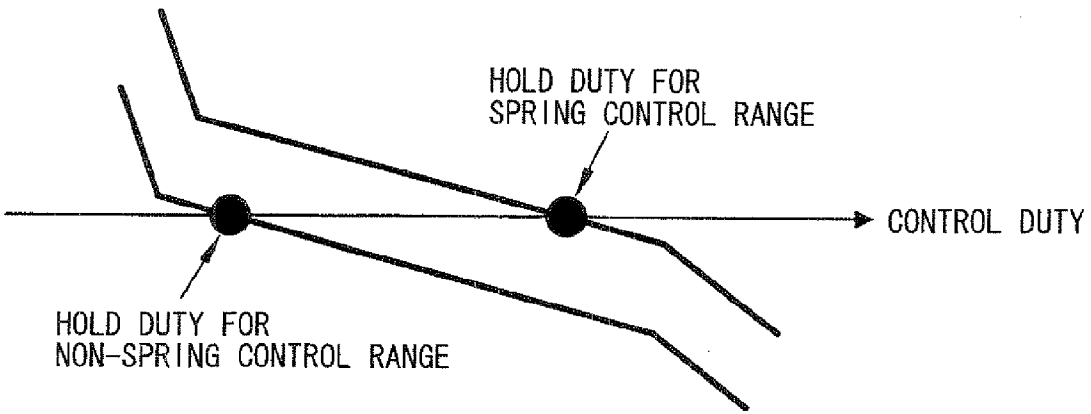
FIG. 6B is an enlarged diagram of a part VIB in FIG. 6A.

As shown in a conceptual diagram of FIG. 5, spring force of the spring 55 is influential over the VCT phase only for a part of the variable range of the actual VCT phase. As shown in FIGS. 6A and 6B, a VCT response speed characteristic of a spring control range (one of the control ranges) is different from a VCT response speed characteristic of a non-spring control range (the other one of the control ranges). A hold duty indicated by the VCT response speed characteristic of the non-spring control range is located on an advance side of the low-responsive range near the high-responsive range due to influence of torque of the intake camshaft 16. In contrast, the hold duty indicated by the VCT response speed characteristic of the spring control range is located on a retard side of the low-responsive range near the other high-responsive range due to influence of the spring force of the spring 55.

Thus, in the first embodiment, the hold duty is learned for each control range, and a control duty of the hydraulic control valve 25 is computed by using the hold duty learning value of the control range, in which the target VCT phase is positioned. In the above case, F/B gains (proportional gain Kp, derivative gain Kd) for computing the F/B correction amount may be changed for each control range.

As shown in FIG. 5, there is an ambiguity range (hereinafter referred as "gray zone") that ranges around the boundary between the spring control range and the non-spring control range, and it is difficult to identify the control characteristic in the ambiguity range. Thus, as shown in FIG. 5, the variable range of the VCT phase is divided into three control ranges that include the spring control range (first control range), the non-spring control range (second control range) and the gray zone (ambiguity range), for example. In general, a limit position of the influential range, in which the spring force of the spring 55 is influential to the actual VCT phase, varies due to the manufacturing variation and the assembly variation of the spring 55 and also due to the aging of the spring force. Thus, in the first embodiment, the spring control range is determined such that spring force of the spring 55 is reliably applied to or influential to the actual VCT phase regardless of the influence of manufacturing variation, assembly variation of the spring 55 and aging of spring force. Accordingly, in the gray zone that is adjacent to the spring control range, it is not known whether the spring force of the spring 55 actually influences the actual VCT phase. As a result, in the gray zone, it is not known whether the real hold duty, which is required to control the oil pressure control valve 25 to really hold the actual VCT phase, is biased in the advance direction or in the retard direction.

Thus, in the first embodiment, a predetermined range around the boundary of the control range is determined as the gray zone, in which it is difficult to identify the control characteristic. When the target VCT phase is positioned away from (or falls beyond) the gray zone, the hold duty learning value of the control range, in which the target VCT phase is positioned, is used to compute the control duty of the hydraulic control valve 25.

In general, when the target VCT phase is in (falls within) the gray zone, it is difficult to determined which to select the hold duty learning values of the two adjacent control ranges because it is difficult to identify the control characteristic in the gray zone. Thus, when the target VCT phase is positioned in the gray zone, it is determined whether a difference, which is measured in an absolute value, between the actual VCT phase and the target VCT phase, is stably equal to or greater than a predetermined value in order to determine whether the selection of the hold duty learning value used in the computation of the control duty of the hydraulic control valve 25 is wrong or not. When it is determined that the difference between the actual VCT phase and the target VCT phase is stably equal to or greater than the predetermined value (in other words, the difference is relatively large), it is determined the discrimination of the control range (the selection of the hold duty learning value) is wrong. In the above case, the hold duty learning value of one of the control ranges adjacent to the gray zone, which is presently used in the computation of the control duty (VCT control amount), is switched to the hold duty learning value of the other one of the control ranges adjacent to the gray zone such that the hold duty learning value of the other control range is used in the computation of the control duty of the hydraulic control valve 25. Alternatively, the control duty of the hydraulic control valve 25 may be corrected in accordance with the difference between the hold duty learning values of the two adjacent control ranges (the one and the other one of the control ranges).

Figure 7:
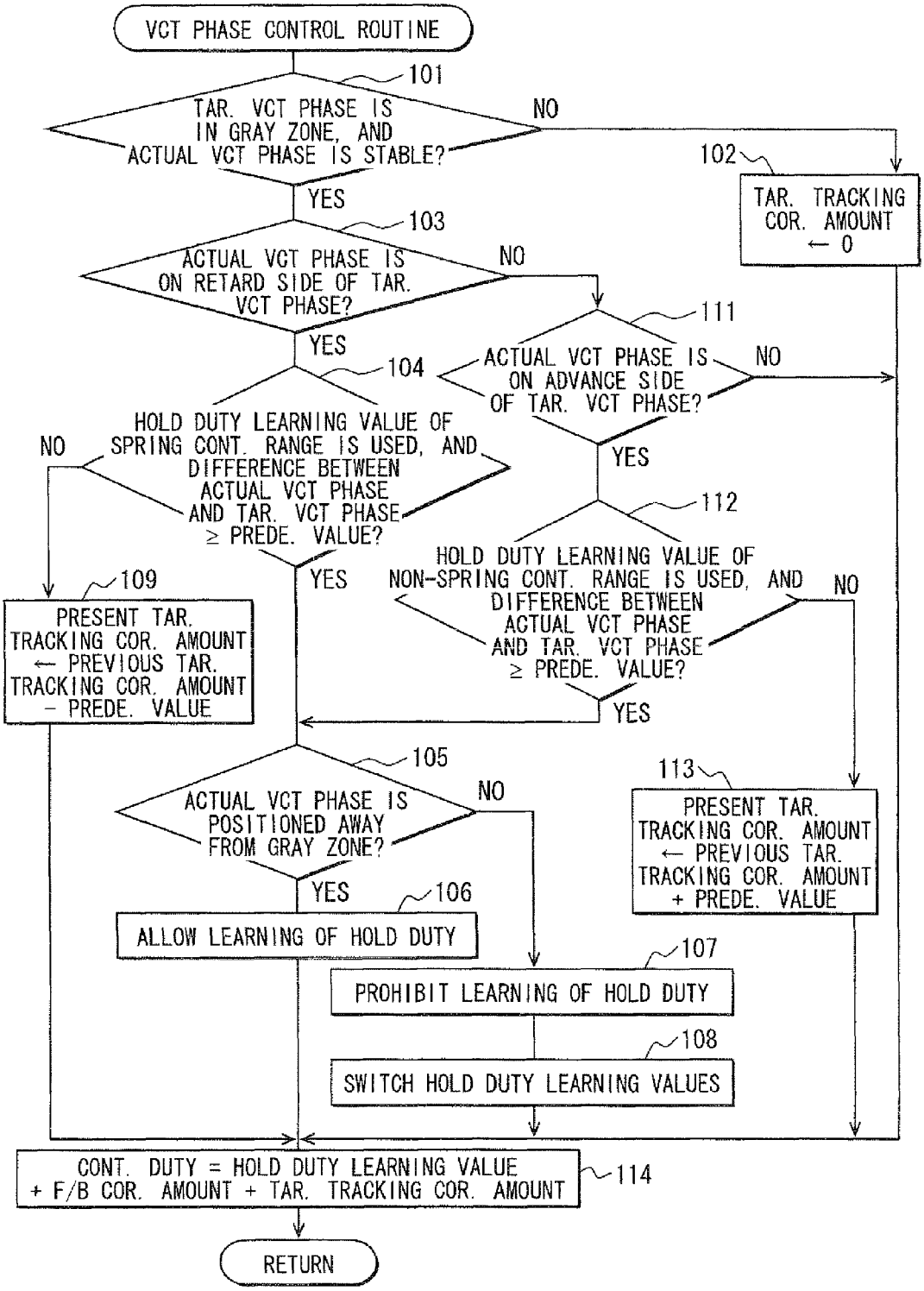
FIG. 7 is a flow chart illustrating a procedure of a VCT phase control routine of the first embodiment.

The VCT phase control according to the first embodiment is executed by the engine control circuit 21 based on a VCT phase control routine in FIG. 7.

The VCT phase control routine of FIG. 7 is repeated during the engine operation at predetermined intervals, and serves as the VCT phase control means. When the present routine is started, firstly control proceeds to step 101, where it is determined whether the following two conditions (a) and (b) are simultaneously satisfied: (a) the target VCT phase is positioned in the gray zone, and (b) the actual VCT phase is stable (or is not substantially moving). When it is determined at step 101 that the above two conditions are not satisfied, corresponding to "No" at step 101, control proceeds to step 102, where the target tracking correction amount is reset to be 0.

In contrast, when it is determined at step 101 that the two conditions are simultaneously satisfied, corresponding to "Yes" at step 101, control proceeds to step 103, where it is determined whether the actual VCT phase is on the retard side of the target VCT phase. When it is determined that the actual VCT phase is on the retard side of the target VCT phase, control proceeds to step 104, where it is determined whether the following two conditions (a) and (b) are simultaneously satisfied: (a) the hold duty learning value of the spring control range is used in the computation of the control duty of the hydraulic control valve 25, and (b) the difference (absolute value) between the actual VCT phase and the target VCT phase is equal to or greater than the predetermined value. When it is determined that the above two conditions are simultaneously satisfied, corresponding to "Yes", control proceeds to step 105, where it is determined whether the actual VCT phase is positioned away from the gray zone.

When it is determined at step 105 that the actual VCT phase is positioned away from the gray zone, control proceeds to step 106, where the learning of the hold duty is allowed. Even when the target VCT phase is positioned in the gray zone, and simultaneously the difference between the actual VCT phase and the target VCT phase is stably equal to or greater than the predetermined value (or in other words, the difference is stably relatively large), erroneous learning of the hold duty will not occur provided that the actual VCT phase is positioned away from the gray zone. More specifically, it is possible to accurately set the control duty for driving the actual VCT phase if the actual VCT phase is positioned away from the gray zone. As a result, even if the hold duty of the control range, in which the actual VCT phase is positioned, is learned, erroneous learning of the hold duty will not occur until the actual VCT phase is shifted to fail within the gray zone.

In contrast, when it is determined at step 105 that the actual VCT phase is positioned in the gray zone, control proceeds to step 107, where the learning of the hold duty is prohibited such that the erroneous learning of the hold duty is prevented. Subsequently, control proceeds to step 108, where the hold duty learning value for the one control range, which has been currently used for the computation of the control duty, is switched to the hold duty learning value for the other control range such that the hold duty learning value for the other control range is used for the computation of the control duty. In the above, alternatively, the F/B gain (proportional gain Kp, derivative gain Kd) for the other control range may replace the F/B gain for the one control range in the computation of the F/B correction amount.

When it is determined "No" at step 104, control proceeds to step 109, where a predetermined value is subtracted from the previous target tracking correction amount in order to compute a present target tracking correction amount. Thus, when the target VCT phase is positioned in the gray zone, and simultaneously the difference between the actual VCT phase and the target VCT phase is stably less than the predetermined value (or in other words, the difference is stably relatively small), a target tracking control is executed. In the target tracking control, the control duty of the hydraulic control valve 25 is gradually corrected in a direction for reducing the difference between the actual VCT phase and the target VCT phase.

Also, when it is determined "No" at step 103, control proceeds to step 111, where it is determined whether the actual VCT phase is on the advance side of the target VCT phase. When it is determined that the actual VCT phase is on the advance side of the target VCT phase, control proceeds to step 112, where it is determined whether the following two conditions (a) and (b) are simultaneously satisfied: (a) the hold duty learning value of the non-spring control range is used and (b) the difference (absolute value) between the actual VCT phase and the target VCT phase is equal to or greater than the predetermined value. When it is determined that the two conditions (a) and (b) are simultaneously satisfied, corresponding to "Yes" at step 112, control proceeds to step 105, where it is determined whether the actual VCT phase is positioned away from the gray zone. When it is determined at step 105 that the actual VCT phase is positioned away from the gray zone, the learning of the hold duty is allowed at step 106. In contrast, when it is determined that the actual VCT phase is positioned in the gray zone, corresponding to "No" at 105, learning of the hold duty is prohibited at step 107, and subsequently control proceeds to step 108, where the hold duty learning value used in the computation of the control duty is switched from the hold duty learning value for the one control range to the hold duty learning value for the other control range as described above.

In contrast, when it is determined "No" at step 112, control proceeds to step 113, where a predetermined value is added to the previous target tracking correction amount in order to compute the present target tracking correction amount. Thus, when the target VCT phase is positioned in the gray zone, and simultaneously the difference between the actual VCT phase and the target VCT phase is stably less than the predetermined value (or in other words, the difference is stably relatively small), the target tracking control is executed. More specifically, in the target tracking control, the control duty of the hydraulic control valve 25 is gradually corrected in the direction for reducing the difference between the actual VCT phase and the target VCT phase.

After the hold duty learning value used in the computation of the control duty and the target tracking correction amount have been determined as above, control proceeds to step 114, where the F/B correction amount and the target tracking correction amount are added to the hold duty learning value in order to obtain the control duty as below.

$$\text{control duty} = \text{hold duty learning value} + F/B \text{ correction amount} + \text{target tracking correction amount}$$

Control examples of the VCT phase control of the first embodiment will be described with reference to FIGS. 8 and 9.

Figure 8:
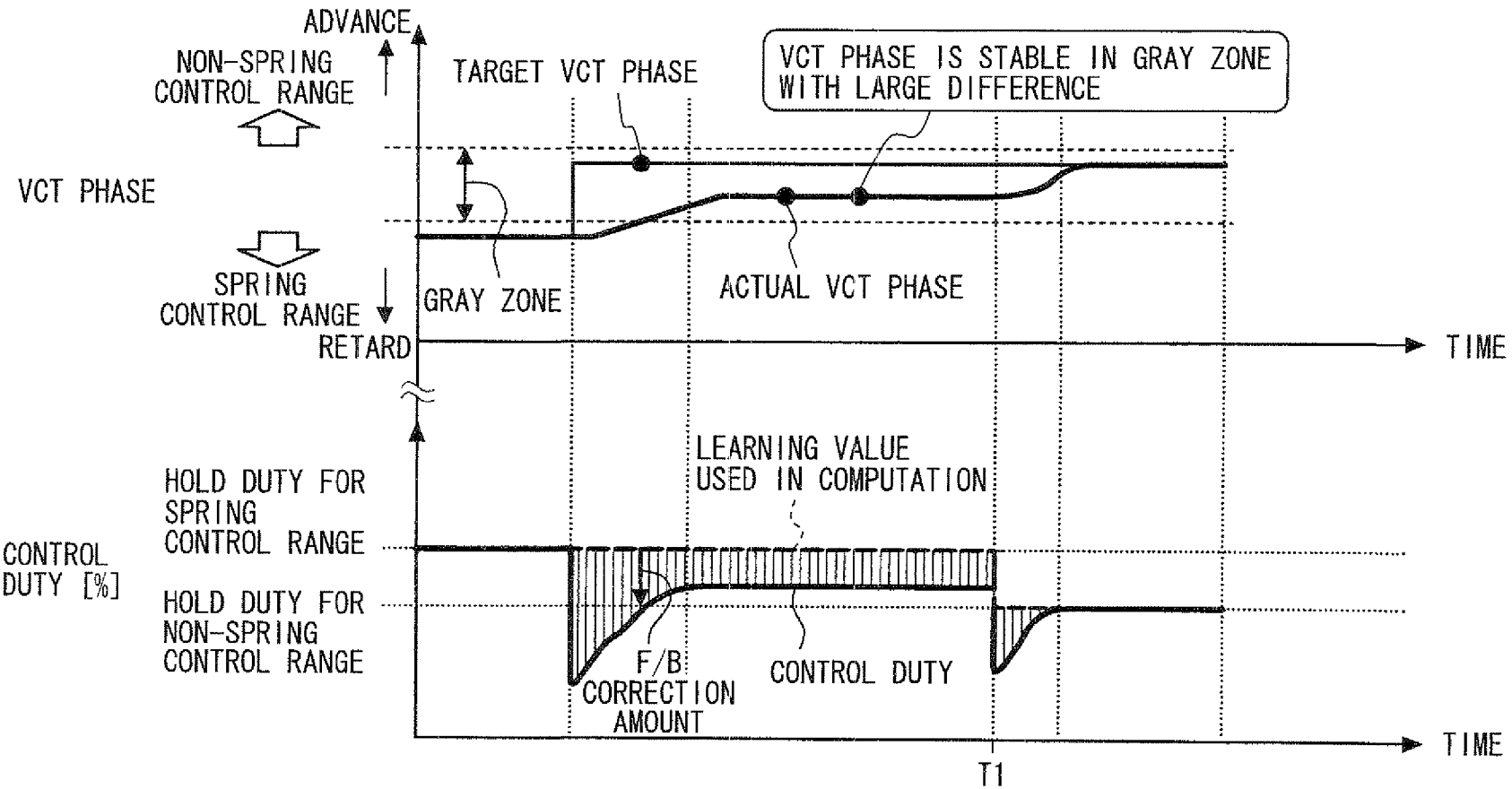
FIG. 8 is a timing chart illustrating the first control example of the VCT phase control according to the first embodiment.

FIG. 8 illustrates a control example (first example), in which the following three conditions (a) to (c) are simultaneously satisfied: (a) the target VCT phase is positioned in the gray zone; (b) the difference between the actual VCT phase and the target VCT phase is stably equal to or greater than the predetermined value (or in other words, the difference is stably relatively large); and (c) the actual VCT phase is positioned in the gray zone. It is assumed that control state as in FIG. 8 is achieved because the actual VCT phase is stable at the end position of the spring 55, or in other words, the actual VCT phase is at the limit position of the influential range of the spring 55. In the above, when it is determined that the selection of the hold duty learning value used for the computation of the control duty of the hydraulic control valve 25 is wrong, the hold duty learning value used in the computation of the control duty of the hydraulic control valve 25 is switched to the hold duty learning value for the other one control range adjacent to the gray zone at time T1. Alternatively, the control duty of the hydraulic control valve 25 may be corrected in accordance with the difference value between the hold duty learning values of the adjacent control ranges. Then, even when the target VCT phase is positioned in the gray zone positioned around the boundary of the control ranges, it is possible to quickly set the control duty at an appropriate value that is determined based on the control range, in which the target VCT phase is actually positioned. As a result, it is possible to improve the accuracy in the VCT phase control around the boundary of the control ranges.

Figure 9:
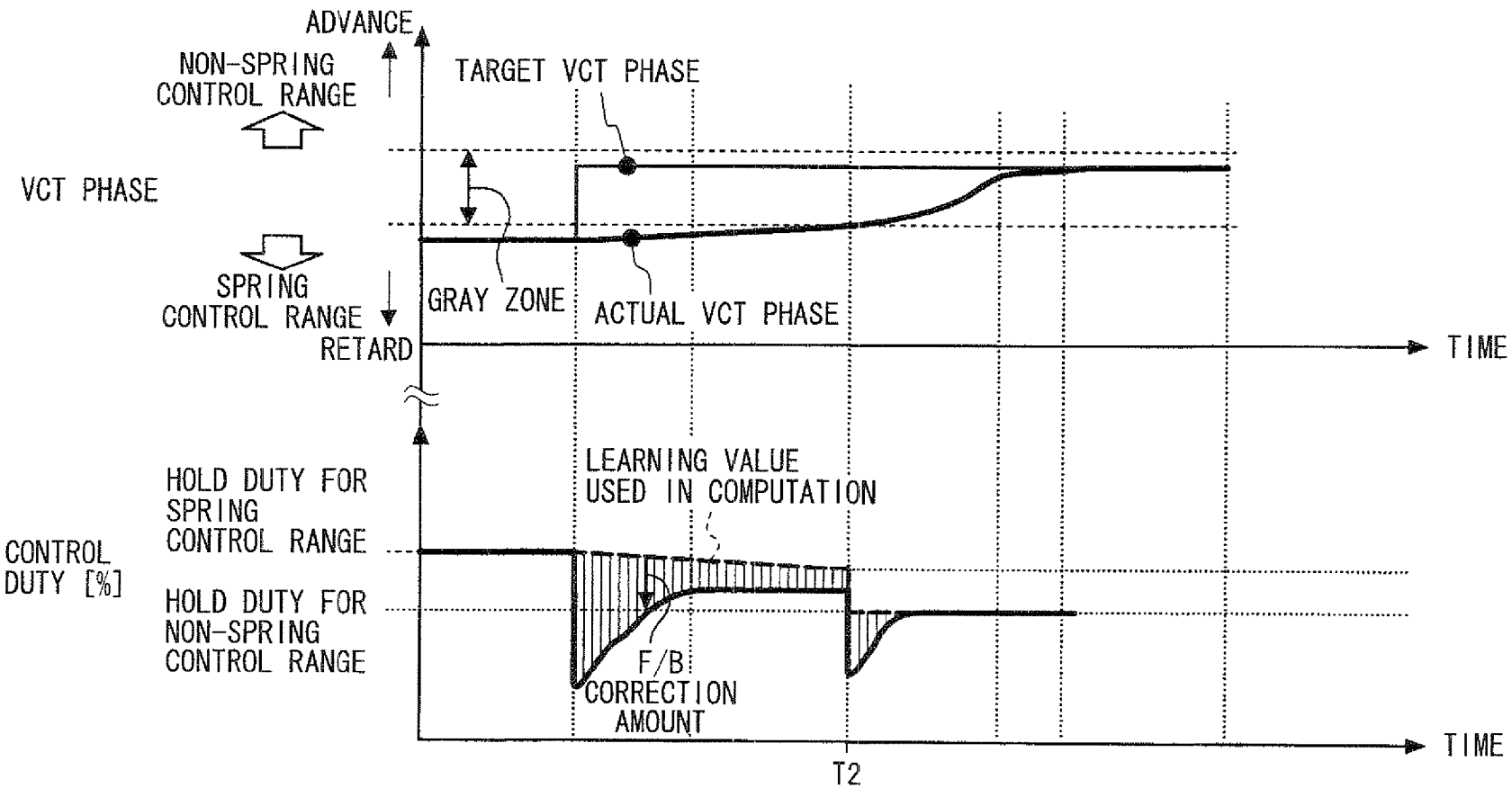
FIG. 9 is a timing chart illustrating the second control example of the VCT phase control according to the first embodiment.

FIG. 9 illustrates another control example (second example), in which the following three conditions (a) to (c) are simultaneously satisfied: (a) the target VCT phase is positioned in the gray zone; (b) the difference between the actual VCT phase and the target VCT phase is stably equal to or greater than the predetermined value (or in other words the difference is stably relatively large); and (c) the actual VCT phase is positioned away from the gray zone. In the above, until the actual VCT phase is shifted to fall within the gray zone, the learning of the hold duty is allowed, and thereby the hold duty learning value used in the computation of the control duty of the hydraulic control valve 25 is updated. Thus, the actual VCT phase is changed to gradually become closer to the target VCT phase. When the actual VCT phase becomes to fall within gray zone at time T1, the learning of the hold duty is prohibited, and the hold duty learning value used in the computation of the control duty of the hydraulic control valve 25 is switched from the hold duty learning value for the one control range to the hold duty learning value for the other one control range adjacent to the gray zone at time T2. Alternatively, the control duty of the hydraulic control valve 25 may be corrected in accordance with the difference between the hold duty learning values for the two control ranges adjacent to the gray zone. Due to the above, even when the target VCT phase is positioned in the gray zone that is positioned around the boundary of the control ranges, it is possible to quickly set the control duty at the appropriate value that is determined based on the control range, in which the target VCT phase is actually positioned. As a result, it is possible to improve the accuracy in the VCT phase control around the boundary of the control ranges.

Second Embodiment

Next, the second embodiment of the present invention will be described with reference to FIGS. 10 to 13. However, the description of the parts that are similar to those in the first embodiment will be omitted or simplified, and the parts different from the first embodiment will be mainly described.

In the second embodiment, when the target VCT phase is positioned away from the gray zone, the hold duty learning value for the control range, in which the target VCT phase is positioned, is used in the computation of the control duty of the hydraulic control valve 25. In contrast, when the target VCT phase is positioned in the gray zone, the learning of the hold duty is prohibited in order to prevent the erroneous learning of the hold duty, also the gray zone is changed if the control state of the actual VCT phase satisfies a predetermined condition.

Specifically, when the target VCT phase is positioned in the gray zone, if a certain condition is satisfied, it is assumed that the actual VCT phase is at the boundary of the control ranges (in other words, the actual VCT phase is at the end position of the spring 55), and thereby a setting range of the gray zone is reduced to a narrower range that include the actual VCT phase. In the above, the certain condition includes both of the followings: (a) the difference between the actual VCT phase and the target VCT phase is stably equal to or greater than the predetermined value; and (b) the control duty of the hydraulic control valve 25 is in a range between the hold duty learning values of the control ranges adjacent to the gray zone or the control duty is near the hold duty learning values. Thus, it is possible to minimize the setting range of the gray zone while the actual boundary of the control range is detected based on the control state of the actual VCT phase.

Also, after minimizing or reducing the setting range of the gray zone, if the other certain condition is satisfied, it is determined that the difference between the actual VCT phase and the target VCT phase has been erroneously enlarged because the present setting range of the gray zone is narrower than an appropriate range. In the above, the other condition includes both of the followings: (a) the target VCT phase falls within a range of the previous gray zone that has not been minimized; and (b) the difference between the actual VCT phase and the target VCT phase is stably equal to or greater than the predetermined value. As above, because it is determined that the present setting range of the gray zone is narrower than the appropriate range, the setting range of the gray zone is enlarged. Due to the above, when it is detected that the setting range of the gray zone, which has been reduced, is narrower than the appropriate range, it is possible to bring the setting range of the gray zone back to its original appropriate range.

Also, when a certain condition is satisfied, the setting range of the gray zone is initialized to the range of the initial gray zone, and also change of the gray zone is prohibited until the hold duty learning values for the two control ranges located adjacent to the gray zone of interest are updated. The certain condition includes the following three conditions: (a) the target VCT phase is positioned in the gray zone; (b) the difference between the actual VCT phase and the target VCT phase is stably equal to or greater than the predetermined value; and (c) the actual VCT phase is positioned away from the initial gray zone. As a result, when it is detected that the control state of the VCT phase control deteriorates due to the change of the setting range of the gray zone, the setting range of the gray zone is initialized back to the range of the initial gray zone, and the change of the gray zone is prohibited until the hold duty learning values of the control ranges are updated.

Also, when a magnitude relation between the hold duty learning values for the two control ranges becomes opposite from a proper magnitude relation, the setting range of the gray zone is initialized back to the range of the initial gray zone. Then, the change of the range of the gray zone is prohibited until the hold duty learning values for the two control ranges are updated such that the hold duty learning values have the proper magnitude relation. In the above, the magnitude relation indicates a relation between the two learning values in terms of the magnitude. Thus, when the magnitude relation (for example, A1>A2) of the two values becomes opposite, the magnitude relation indicates A1<A2. Accordingly, when the magnitude relation of the hold duty learning values for the two control ranges becomes opposite from the proper magnitude relation, it is obviously assumed that the hold duty learning values become wrong. Thus, the setting range of the gray zone is initialized to the range of the initial gray zone, and then the learning of the hold duty is executed from the beginning with the initial gray zone.

Figure 10:
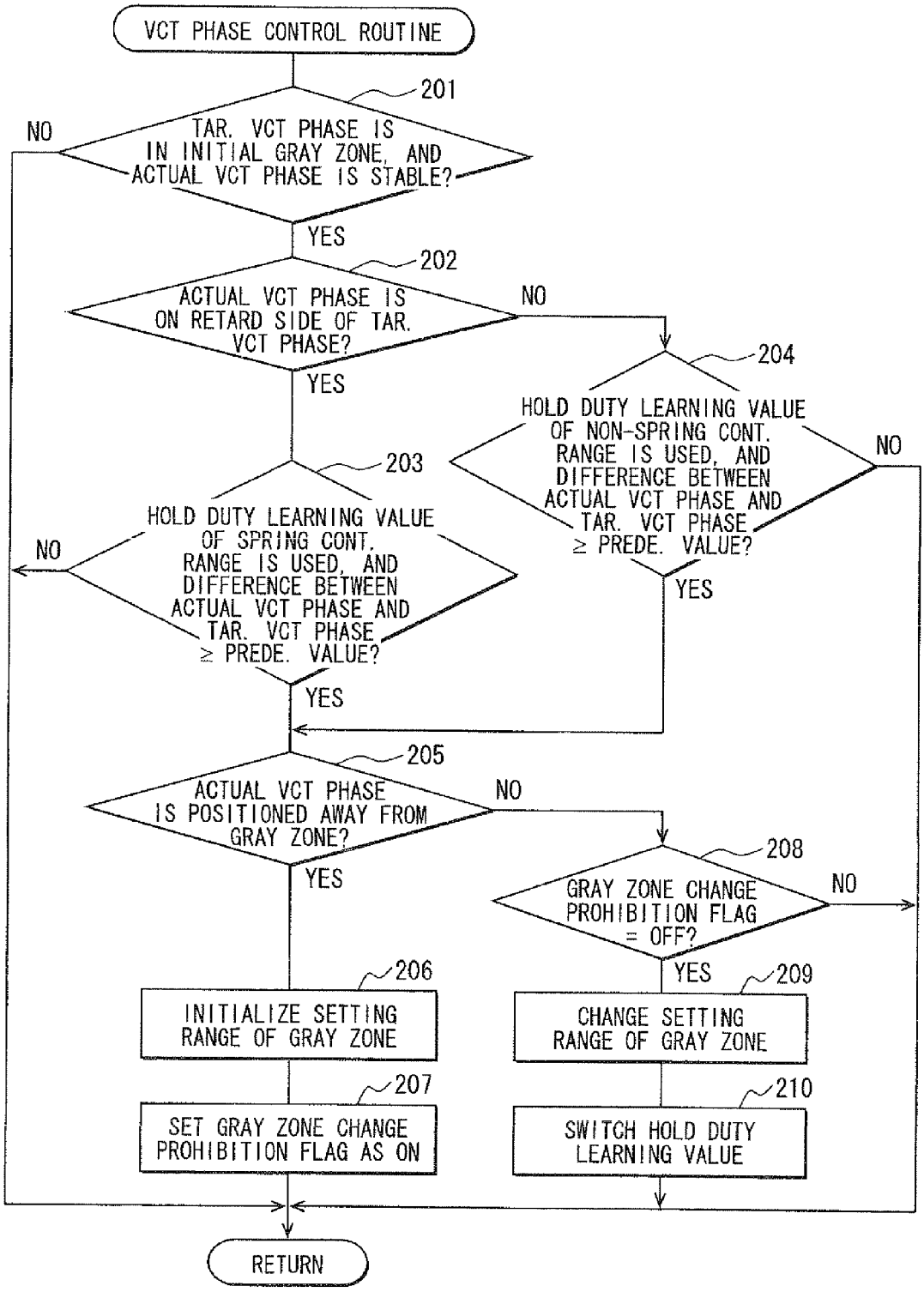
FIG. 10 is a flow chart illustrating a procedure of the VCT phase control routine according to the second embodiment.
Figure 11:
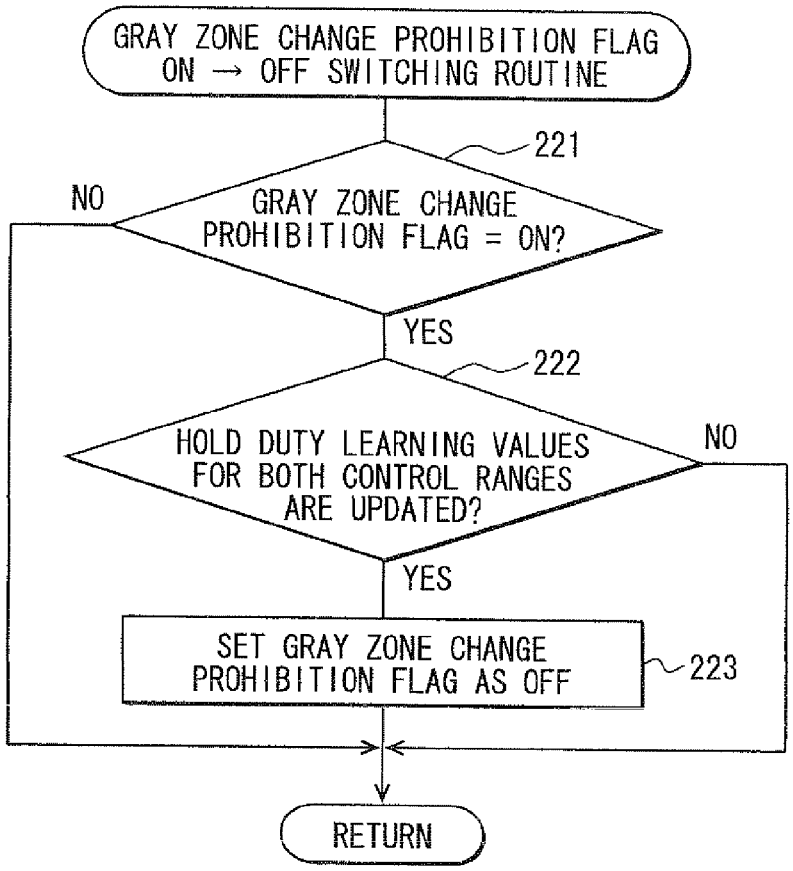
FIG. 11 is a flow chart illustrating a procedure of a gray zone change prohibition flag ON→OFF switching routine according to the second embodiment.
Figure 12:
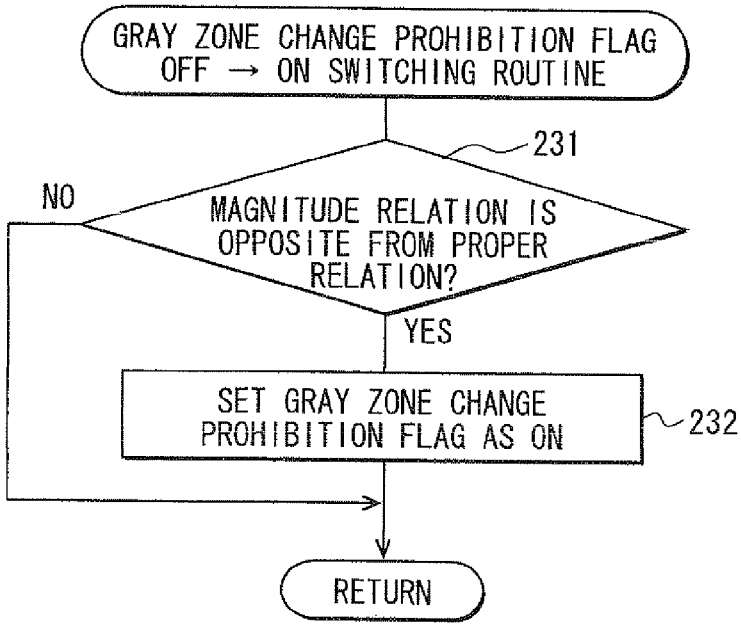
FIG. 12 is a flow chart illustrating a procedure of a gray zone change prohibition flag OFF→ON switching routine according to the second embodiment.

The VCT phase control of the second embodiment is executed by the engine control circuit 21 based on each routine in FIGS. 10 to 12. The procedure in each routine of FIGS. 10 to 12 will be described below.

[VCT Phase Control Routine]

The VCT phase control routine in FIG. 10 is repeatedly executed at predetermined intervals during the engine operation and serves as VCT phase control means. When the present routine is started, firstly, it is determined at step 201 whether the following two conditions (a) and (b) are simultaneously satisfied: (a) the target VCT phase is positioned in the initial gray zone; and (b) the actual VCT phase is stable (or not moving). When it is determined that the above two conditions (a) and (b) are not simultaneously satisfied, corresponding to "No" at step 201, the present routine is ended without executing the subsequent process.

In contrast, when it is determined "Yes" at step 201, control proceeds to step 202, where it is determined whether the actual VCT phase is on the retard side of the target VCT phase. When it is determined that the actual VCT phase is on the retard side of the target VCT phase, control proceeds to step 203, where it is determined whether the following two conditions (a) and (b) are simultaneously satisfied: (a) the hold duty learning value of the spring control range is used in the computation of the control duty; and (b) the difference (absolute value) between the actual VCT phase and the target VCT phase is equal to or greater than the predetermined value. When it is determined that the above two conditions (a) and (b) are not simultaneously satisfied, corresponding to "No" at step 203, the present routine is ended without executing the subsequent process. When it is determined "Yes" at step 203, control proceeds to step 205, where it is determined whether the actual VCT phase is positioned away from the gray zone.

When it is determined at step 202 that the actual VCT phase is on the advance side of the target VCT phase, control proceeds to step 204, where it is determined whether the following two conditions (a) and (b) are simultaneously satisfied: (a) the hold duty learning value of the non-spring control range is used in the computation of the control duty; and (b) the difference (absolute value) between the actual VCT phase and the target VCT phase is equal to or greater than the predetermined value. When it is determined that the above two conditions are not simultaneously satisfied, corresponding to "No" at step 204, the present routine is ended without executing the subsequent process. When it is determined "Yes" at step 204, control proceeds to step 205, where it is determined whether the actual VCT phase is positioned away from the gray zone.

When it is determined at step 205 that the actual VCT phase is positioned away from the gray zone, control proceeds to step 206, where the setting range of the gray zone is initialized back to the range of the initial gray zone. Then, control proceeds to step 207, where a gray zone change prohibition flag is set to be ON, which indicates the prohibition of the change of the gray zone, and then the present routine is ended.

In contrast, when it is determined at step 205 that the actual VCT phase is positioned in the gray zone, control proceeds to step 208, where it is determined whether the gray zone change prohibition flag is OFF. When the gray zone change prohibition flag is ON (indicating prohibition of the change of the gray zone), the present routine is ended.

When it is determined at step 208 that the gray zone change prohibition flag is OFF (indicating allowance of the change of the gray zone), control proceeds to step 209, where the setting range of the gray zone is changed to a range defined between (a) the present actual VCT phase−α a and (b) the present actual VCT phase+α. In other words, the setting range of the gray zone is changed to the present actual VCT phase±α. For example, α is determined to a level such that the changed setting range of the gray zone (actual VCT phase±α) is narrower than the range of the initial gray zone. Then, control proceeds to step 210, where the hold duty learning value for the other control range is used instead in the computation of the control duty. For example, if the hold duty learning value for the spring control range has been used in the computation, the hold duty learning value used in the computation is switched from the hold duty learning value for the spring control range to the hold duty learning value for the non-spring control range, and vice versa. Alternatively, the F/B gain (proportional gain Kp, derivative gain Kd) of the other control range may be used for the computation of the F/B correction amount.

[Gray Zone Change Prohibition Flag ON→OFF switching Routine]

A gray zone change prohibition flag ON→OFF switching routine shown in FIG. 11 is repeatedly executed at predetermined intervals during the engine operation. When the present routine is started, firstly, it is determined at step 221 whether the gray zone change prohibition flag is ON (prohibition of the change of the gray zone). When it is determined that the gray zone change prohibition flag is OFF (allowance of the change of the gray zone), the present routine is ended.

In contrast, when it is determined at step 221 that the gray zone change prohibition flag is ON (prohibition of the change of the gray zone), control proceeds to step 222, where it is determined whether the hold duty learning values for the spring control range and the non-spring control range are updated after the gray zone change prohibition flag has been turned ON. When it is determined that the hold duty learning values for both of the control ranges are not updated, the present routine is ended. When it is determined that the hold duty learning values for both of the control ranges are updated, control proceeds to step 223, where the gray zone change prohibition flag is reset to be OFF, and then the present routine is ended.

[Gray Zone Change Prohibition Flag OFF→ON Switching Routine]

A gray zone change prohibition flag OFF→ON switching routine in FIG. 12 is repeatedly executed at predetermined intervals during the engine operation. When the present routine is started, firstly it is determined at step 231 whether the magnitude relation of the hold duty learning values becomes opposite from the proper magnitude relation by comparing the hold duty learning value of the spring control range with the hold duty learning value of the non-spring control range. In other words, it is determined whether the following equation is satisfied.

hold duty learning value of spring control range<hold duty learning value of non-spring control range When it is determined that the magnitude relation becomes opposite from the proper magnitude relation, corresponding to "Yes" at step 231, control proceeds to step 232, where the gray zone change prohibition flag is set to be ON (prohibition of the change of the gray zone), and then the present routine is ended.

In contrast, when it is determined "No" at step 231, or in other words, when it is determined that the magnitude relation between (a) the hold duty learning value of the spring control range and (b) the hold duty learning value of the non-spring control range indicates the proper magnitude relation, the present routine is ended.

One example of the VCT phase control according to the second embodiment will be described with reference to FIG. 13.

Figure 13:
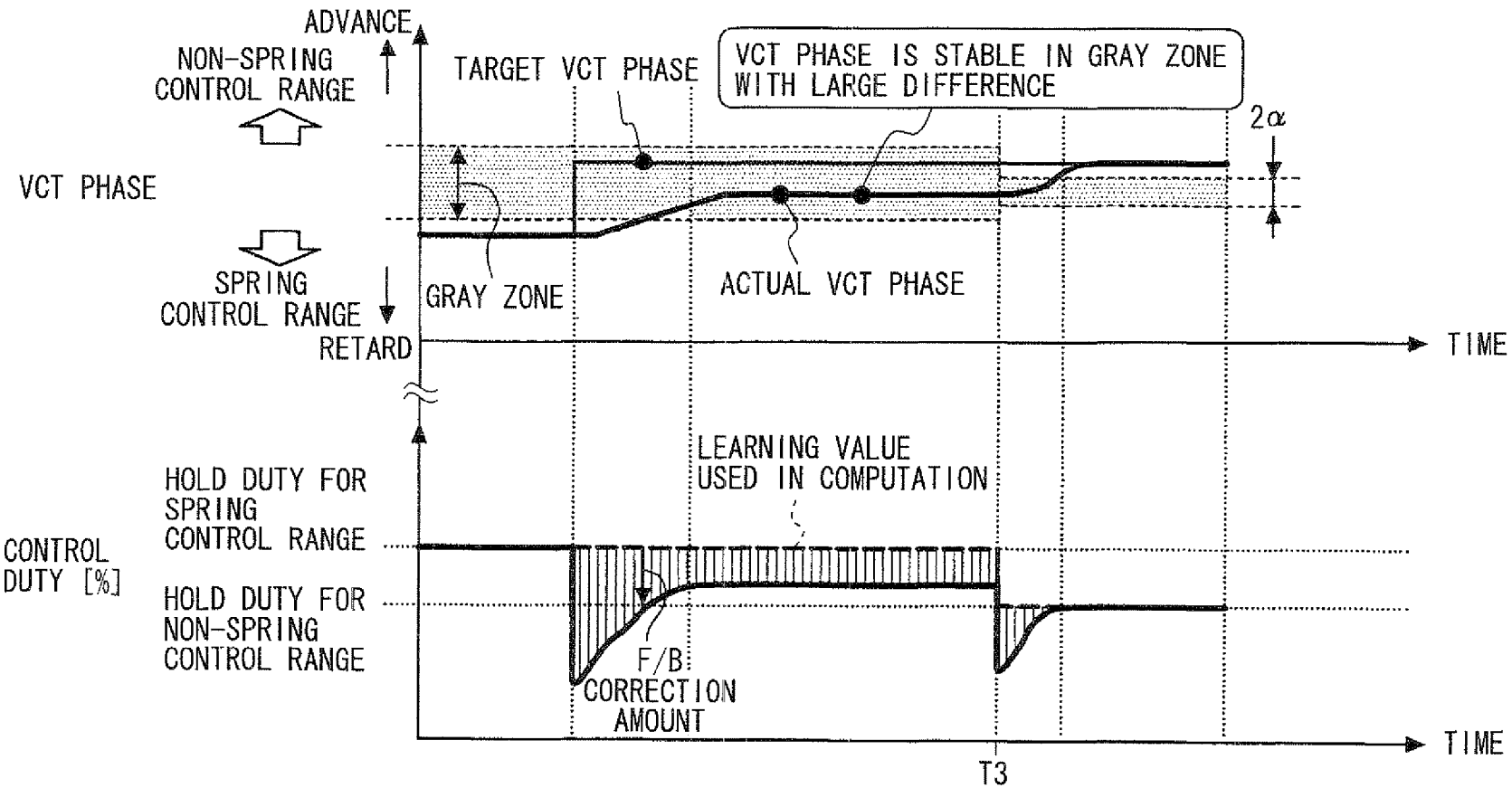
FIG. 13 is a timing chart illustrating one example of a VCT phase control according to the second embodiment.

FIG. 13 illustrates a control example, in which the following conditions (a) to (c) are satisfied: (a) the target VCT phase is positioned in the gray zone; (b) the difference between the actual VCT phase and the target VCT phase is stably equal to or greater than the predetermined value (or in other words, the difference is stably relatively large); and (c) the actual VCT phase is positioned in the gray zone. It is assumed that control state as in FIG. 13 is achieved because the actual VCT phase is stable at the end position of the spring 55. In the above, when it is detected that the difference between the actual VCT phase and the target VCT phase is stably equal to or greater than the predetermined value, the setting range of the gray zone is changed into the present actual VCT phase±α at time T3. As described above, the changed set range (actual VCT phase±α) the gray zone is narrower than the initial gray zone as shown in FIG. 13. Thus, because the target VCT phase becomes to fall beyond the gray zone due to the change of the range of the gray zone as above, the hold duty learning value of the control range (the non-spring control range in the example of FIG. 13), in which the target VCT phase is positioned, is used in the computation of the control duty of the hydraulic control valve 25. Due to the above, even when the target VCT phase is positioned in the gray zone around the boundary of the control ranges, it is possible to quickly set the control duty at an appropriate value that is determined based on the control range, in which the target VCT phase is actually positioned. As a result, it is possible to improve the accuracy of the VCT phase control around the boundary of the control ranges.

it is noted that the present invention is not limited to the above first and the second embodiments. For example, a hydraulic control valve, which controls oil pressure for actuating the VCT phase, may be alternatively separate from another hydraulic control valve, which controls oil pressure for actuating the lock pin 58 to perform the lock control.

Note that, the present invention is embodied as the variable valve timing control apparatus of the intake valve in the above first and the second embodiments. However, the present invention may be alternatively applicable to a variable valve timing control apparatus of the exhaust valve. In the alternative case, where the present invention is applied to the variable valve timing control apparatus of the exhaust valve, a direction of controlling the VCT phase of the exhaust valve may be alternatively set opposite from the direction of controlling the VCT phase of the intake valve in the above embodiment. In other words, a directional relation between "timing advance" and "timing retard" in the above embodiment may be reversed in the alternative embodiment for the exhaust valve.

The present invention may be modified in a various manner provided that the modification does not deviate from the gist of the present invention. For example, a configuration of the variable valve timing unit 18 and a configuration of the hydraulic control valve 25 may be modified as required.

Additional advantages and modifications will readily occur to those skilled in the art. The invention in its broader terms is therefore not limited to the specific details, representative apparatus, and illustrative examples shown and described.

What is claimed is:

1. A variable valve timing control apparatus for an internal combustion engine having a crankshaft and a camshaft, the variable valve timing control apparatus comprising:

a hydraulic variable valve timing unit configured to adjust valve timing by changing a variable cam timing (VCT) phase that is a rotational phase of the camshaft relative to the crankshaft;

an oil pressure control device configured to control oil pressure that actuates the variable valve timing unit;

VCT phase control means for feed-back controlling a VCT control amount of the oil pressure control device such that an actual VCT phase becomes a target VCT phase, wherein:

the variable valve timing unit is configured to have a plurality of control ranges of the VCT phase, each of which has a different control characteristic; and an ambiguity range is a predetermined range defined around a boundary between the plurality of control ranges and has a control characteristic that is difficult to be identified; and hold control amount learning means for learning a hold control amount for each of the plurality of control ranges when a predetermined hold control amount learning execution condition is satisfied, the hold control amount being required to control the oil pressure control device to maintain the actual VCT phase, wherein:

when the target VCT phase is positioned away from the ambiguity range, the VCT phase control means computes the VCT control amount by using the hold control amount learning value of one of the plurality of control ranges, in which the target VCT phase is positioned;

when the target VCT phase is positioned in the ambiguity range, if a difference between the actual VCT phase and the target VCT phase is stably equal to or greater than a predetermined value, the VCT phase control means executes a VCT control amount computation process, in which one of the following is performed:

the VCT phase control means switches the hold control amount learning value of one of the plurality of control ranges, which is presently used in computation of the VCT control amount, into the hold control amount learning value for the other one of the plurality of control ranges such that the hold control amount learning value for the other one of the plurality of control ranges is used in the computation of the VCT control amount, the other one of the plurality of control ranges being positioned adjacent to the ambiguity range; and the VCT phase control means corrects the VCT control amount based on a difference between the hold control amount learning values of two of the plurality of control ranges, which are positioned adjacent to the ambiguity range.

2. The variable valve timing control apparatus according to claim 1, wherein:

when the target VCT phase is positioned in the ambiguity range, the VCT control amount computation process is executed while the VCT phase control means prohibits the hold control amount learning means from learning the hold control amount, if the following two conditions are simultaneously satisfied:

the difference between the actual VCT phase and the target VCT phase is stably equal to or greater than the predetermined value; and the actual VCT phase is positioned in the ambiguity range.

3. The variable valve timing control apparatus according to claim 2, wherein:

when the target VCT phase is positioned away from the ambiguity range, if the difference between the actual VCT phase and the target VCT phase is stably equal to or greater than the predetermined value, and simultaneously if the actual VCT phase is positioned away from the ambiguity range, the VCT phase control means executes the followings:

until the actual VCT phase is shifted to be positioned in the ambiguity range, the VCT phase control means allows the hold control amount learning means to learn the hold control amount; and after the actual VCT phase is shifted to be positioned in the ambiguity range, the VCT phase control means executes the VCT control amount computation process while the VCT phase control means prohibits the hold control amount learning means from learning the hold control amount.

4. The variable valve timing control apparatus according to claim 1, wherein:

when the target VCT phase is positioned in the ambiguity range, if the difference between the actual VCT phase and the target VCT phase is stably less than a predetermined value, the VCT phase control means executes a target tracking control, in which the VCT phase control means corrects the VCT control amount in a direction for reducing the difference between the actual VCT phase and the target VCT phase.

5. A variable valve timing control apparatus for an internal combustion engine having a crankshaft and a camshaft, the variable valve timing control apparatus comprising:

a hydraulic variable valve timing unit configured to adjust valve timing by changing a variable cam timing (VCT) phase that is a rotational phase of the camshaft relative to the crankshaft;

an oil pressure control device configured to control oil pressure that actuates the variable valve timing unit;

VCT phase control means for feed-back controlling a VCT control amount of the oil pressure control device such that an actual VCT phase becomes a target VCT phase, wherein:

the variable valve timing unit is configured to have a plurality of control ranges of the VCT phase, each of which has a different control characteristic; and an ambiguity range is a predetermined range defined around a boundary between the plurality of control ranges and has a control characteristic that is difficult to be identified; and hold control amount learning means for learning a hold control amount for each of the plurality of control ranges when a predetermined hold control amount learning execution condition is satisfied, the hold control amount being required to control the oil pressure control device to maintain the actual VCT phase, wherein:

when the target VCT phase is positioned away from the ambiguity range, the VCT phase control means computes the VCT control amount by using the hold control amount learning value of one of the plurality of control ranges, in which the target VCT phase is positioned; and when the target VCT phase is positioned in the ambiguity range, the VCT phase control means executes the followings:

the VCT phase control means prohibits the hold control amount learning means from learning the hold control amount; and the VCT phase control means changes the ambiguity range if a control state of the actual VCT phase satisfies a predetermined condition.

6. The variable valve timing control apparatus according to claim 5, wherein:

when the target VCT phase is positioned in the ambiguity range, the VCT phase control means reduces a setting range of the ambiguity range to a range that includes the actual VCT phase if the following conditions are simultaneously satisfied:

the difference between the actual VCT phase and the target VCT phase is stably equal to or greater than a predetermined value; and the VCT control amount is presently between the hold control amount learning values of two of the plurality of control ranges, or the VCT control amount is presently around the hold control amount learning values, the two of the plurality of control ranges being positioned adjacent to the ambiguity range.

7. The variable valve timing control apparatus according to claim 6, wherein:

after the VCT phase control means reduces the setting range of the ambiguity range, the VCT phase control means increases the setting range of the ambiguity range if the following conditions are simultaneously satisfied:

the target VCT phase is positioned in a previous ambiguity range, the setting range of which has not been reduced; and the difference between the actual VCT phase and the target VCT phase is stably equal to or greater than the predetermined value.

8. The variable valve timing control apparatus according to claim 5, wherein:

the VCT phase control means initializes the setting range of the ambiguity range back to an initial ambiguity range, and the VCT phase control means prohibits the ambiguity range from being changed until the hold control amount learning values of two of the plurality of control ranges, which are positioned adjacent to the ambiguity range, are updated when the following three conditions are simultaneously satisfied:

the target VCT phase is positioned in the ambiguity range;

the difference between the actual VCT phase and the target VCT phase is stably equal to or greater than a predetermined value; and the actual VCT phase is positioned away from the initial ambiguity range.

9. The variable valve timing control apparatus according to claim 5, wherein:

when a magnitude relation between the hold control amount learning values of two of the plurality of control ranges, which are positioned adjacent to the ambiguity range, becomes opposite from a proper magnitude relation, the VCT phase control means initializes the setting range of the ambiguity range back to an initial ambiguity range, and prohibits the ambiguity range from being changed until the hold control amount learning values of two of the plurality of control ranges, which are positioned adjacent to the ambiguity range, are updated to have the proper magnitude relation.

10. The variable valve timing control apparatus according to claim 1, further comprising:

a lock pin configured to lock the actual VCT phase at an intermediate lock position located within the variable adjustable range of the actual VCT phase, wherein:

the oil pressure control device uses a hydraulic control valve, which includes first means for controlling oil pressure that actuates the VCT phase and second means for controlling oil pressure that actuates the lock pin; and the hydraulic control valve is operated under following operational modes in accordance with the control amount;

the hydraulic control valve shifts the VCT phase in a retard direction under a retard operation mode;

the hydraulic control valve maintains the VCT phase under a hold mode;

the hydraulic control valve shifts the VCT phase in an advance direction under an advance operation mode; and the hydraulic control valve allows the lock pin to be displaced in a lock direction under a lock mode.

11. The variable valve timing control apparatus according to claim 5, further comprising:

a lock pin configured to lock the actual VCT phase at an intermediate lock position located within the variable adjustable range of the actual VCT phase, wherein:

the oil pressure control device uses a hydraulic control valve, which includes first means for controlling oil pressure that actuates the VCT phase and second means for controlling oil pressure that actuates the lock pin; and the hydraulic control valve is operated under following operational modes in accordance with the control amount;

the hydraulic control valve shifts the VCT phase in a retard direction under a retard operation mode;

the hydraulic control valve maintains the VCT phase under a hold mode;

the hydraulic control valve shifts the VCT phase in an advance direction under an advance operation mode; and the hydraulic control valve allows the lock pin to be displaced in a lock direction under a lock mode.

12. A variable valve timing control apparatus for an internal combustion engine having a crankshaft and a camshaft, the variable valve timing control apparatus comprising:

a hydraulic variable valve timing unit configured to adjust valve timing by changing a variable cam timing (VCT) phase that is a rotational phase of the camshaft relative to the crankshaft;

an oil pressure control device configured to control oil pressure that actuates the variable valve timing unit;

VCT phase control means for feed-back controlling a VCT control amount of the oil pressure control device such that an actual VCT phase becomes a target VCT phase, wherein:

the VCT phase is variable within a variable range that is divided into a first control range, a second control range, and an ambiguity range;

the ambiguity range is adjacently positioned between the first and second control ranges and has a control characteristic that is difficult to be identified; and the first and second control ranges have different control characteristic from each other; and hold control amount learning means for learning a hold control amount for each of the first and second control ranges when a predetermined hold control amount learning execution condition is satisfied, the hold control amount being required to control the oil pressure control device to maintain the actual VCT phase, wherein:

when the target VCT phase is positioned away from the ambiguity range, the VCT phase control means computes the VCT control amount by using the hold control amount learning value of one of the first and second control ranges, in which the target VCT phase is positioned; and when the target VCT phase is positioned in the ambiguity range, if a difference between the actual VCT phase and the target VCT phase is stably equal to or greater than a predetermined value, one of the following is performed:

the VCT phase control means switches the hold control amount learning value used in computation of the VCT control amount from the hold control amount learning value for the first control range, which is presently used in computation of the VCT control amount, to the hold control amount learning value for the second control range such that the VCT phase control means computes the VCT control amount by using the hold control amount learning value for the second control range; and the VCT phase control means corrects the VCT control amount based on a difference between the hold control amount learning values of the first and second control ranges.

* * * * *